US005784786A

United States Patent [19]

Williams

[11] Patent Number: 5,784,786

[45] Date of Patent: Jul. 28, 1998

[54] BLADE SCABBARD AND SHARPENER

[75] Inventor: David Mark Williams, Eyan, England

[73] Assignee: McPherson's Limited, Victoria, Australia

[21] Appl. No.: 809,427

[22] PCT Filed: Oct. 5, 1995

[86] PCT No.: PCT/AU95/00652

§ 371 Date: Apr. 4, 1997

§ 102(e) Date: Apr. 4, 1997

[87] PCT Pub. No.: WO96/11086

PCT Pub. Date: Apr. 18, 1996

[30] Foreign Application Priority Data

Oct. 5, 1994 [AU] Australia ..... PM 8597
Oct. 7, 1994 [AU] Australia ..... PM 8641

[51] Int. Cl.[6] ..... B24D 13/08; B26B 29/02

[52] U.S. Cl. ..... 30/138; 30/298.4

[58] Field of Search ..... 30/138, 298.4, 30/123; 76/82, 86; 431/231, 232, 234, 371, 163, 349

[56] References Cited

U.S. PATENT DOCUMENTS

| | | | |
|---|---|---|---|
| 3,958,330 | 5/1976 | Hutchens . | |
| 4,091,691 | 5/1978 | Bayly | 30/138 X |
| 4,414,744 | 11/1983 | Collins . | |
| 4,654,968 | 4/1987 | Gatley et al. | 30/138 |
| 4,726,498 | 2/1988 | Esposito . | |
| 4,805,350 | 2/1989 | Farrer | 30/138 |
| 4,974,322 | 12/1990 | Butka | 30/138 |
| 5,115,953 | 5/1992 | Werner . | |

FOREIGN PATENT DOCUMENTS

| | | |
|---|---|---|
| 1467870 | 11/1971 | Australia . |
| 3670871 | 6/1973 | Australia . |
| 2659577 | 1/1979 | Australia . |
| 8667582 | 11/1983 | Australia . |
| 2159683 | 5/1984 | Australia . |
| 243048 | 10/1987 | European Pat. Off. . |
| 271223 | 6/1988 | European Pat. Off. . |
| 1464775 | 2/1977 | United Kingdom . |
| 2168275 | 6/1986 | United Kingdom . |

*Primary Examiner*—Douglas D. Watts

*Attorney, Agent, or Firm*—Trexler, Bushnell, Giangiorgi & Blackstone, Ltd.

[57] ABSTRACT

A blade scabbard including a safety lock which functions to prevent accidental or inadvertent withdrawal of a blade from a fully inserted position within the scabbard housing. The safety lock operates automatically in response to insertion of a blade into the scabbard and is preferably associated with blade sharpening mechanism which is also responsive to movement of a blade into and out of the scabbard housing. The sharpening mechanism is preferably inactive during blade insertion and active during blade withdrawal. Manually operable release means is provided to enable release of the lock for blade withdrawal purposes, and it is necessary to operate the release means while simultaneously withdrawing the blade from the scabbard. The safety lock is fully released after the blade has been withdrawn a distance from the fully inserted position and operation of the release means can then be terminated without hindering further withdrawal of the blade. Blade restraining means coacts with the blade to prevent withdrawal when the safety lock is fully operative, and that restraining means may be pivotally mounted on the scabbard housing, together with the sharpening mechanism, to be pivoted into and out of the operative position.

29 Claims, 6 Drawing Sheets

BLADE SCABBARD AND SHARPENER

This invention relates to blade scabbards, and is particularly but not exclusively concerned with knife and scissor blade scabbards. It will be convenient to hereinafter describe the invention with particular reference to knife blade scabbards of the kind incorporating a mechanism for sharpening the blade cutting edge.

Examples of combined scabbard-sharpeners are disclosed by U.S. Pat. Nos. 3,676,961, 3,774,350, 4,041,651, 4,091,691, 4,805,350 and 5,009,040.

It is generally the case that scabbard-sharpeners of the foregoing kind do not include means for resisting withdrawal or dislodgment of a contained knife blade. That leads to the possibility of a child withdrawing the knife blade, and the further possibility of the blade being dislodged from the scabbard by accident or inadvertence. In any of those situations a person could sustain injury from the sharp cutting edge of the exposed blade.

An object of the present invention is to provide a blade scabbard with restraining means which is operative to effectively prevent or substantially hinder removal of a contained blade. It is an object of the invention in a preferred form to provide such restraining means which is automatically rendered operative when a blade is inserted into the scabbard.

A blade scabbard according to the invention is characterised in that it intrudes restraining means which coacts with a blade inserted into the scabbard, or coacts with a member associated with that blade, so as to thereby resist withdrawal of the blade from the scabbard. The scabbard further includes release means which is operable to render the restraining means inoperative. In a preferred arrangement, insertion of a blade into the scabbard has the consequence of automatically causing the restraining means to become operative. It is also preferred that the release means requires deliberate manipulation and is at least difficult to operate by the same hand as that being used in an attempt to withdraw the blade from the scabbard.

In circumstances where the scabbard includes a blade sharpening mechanism, the restraining means may be associated with that mechanism. By way of example, the sharpening mechanism may be arranged for movement between active and inactive positions, and in that event the restraining means may be responsive to such movement so as to be rendered operative when the sharpening mechanism is inactive. When the restraining means is operative, it is preferred that a member forming part of that means coacts with a blade in a manner such as to prevent or resist relative movement of the blade in a direction such that the blade would be withdrawn from the scabbard. It is further preferred that movement of the restraining member out of a blade restraining position is necessary in order to free the blade for withdrawal from the scabbard, and releasable locking means may be provided to prevent that movement. Operation of the release means to release the looking means may have the result of permitting movement of the sharpening mechanism into its active position and simultaneously causing or permitting the restraining means to be rendered inoperative.

It is further preferred that two activities must occur simultaneously in order to free the blade for withdrawal from the scabbard. In particular, it is preferred that operation of the release means alone is not sufficient to free the blade. In one arrangement, the blade must be moved in the blade withdrawal direction while the release means is operated, and failure to do those two things simultaneously will result in the blade restraining means continuing to prevent or hinder withdrawal of the blade from the scabbard.

Embodiments of the invention are described in detail in the following passages of the specification which refer to the accompanying drawings. The drawings, however, are merely illustrative of how the invention might be put into effect, so that the specific form and arrangement of the various features as shown is not to be understood as limiting on the invention.

Figure 1:
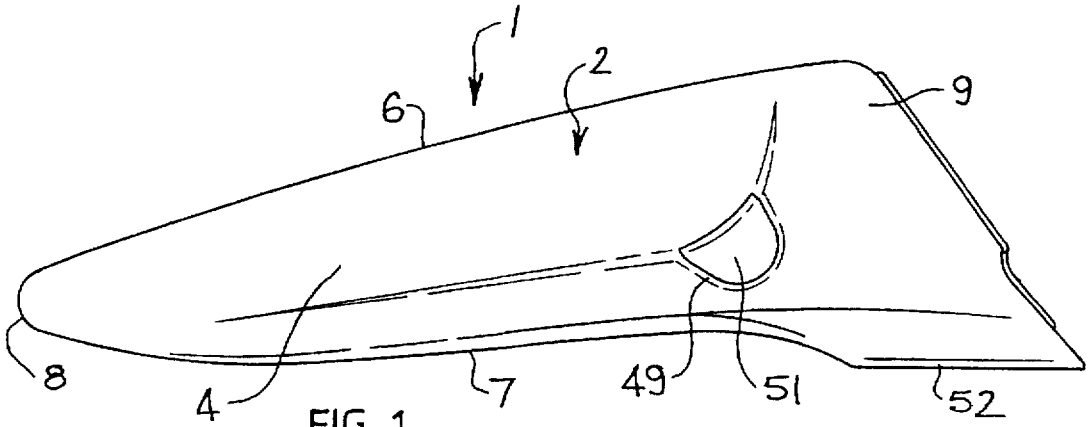
FIG. 1 is a side elevation view of an example scabbard incorporating one particular embodiment of the invention.

In the particular embodiment shown in the drawings, the scabbard includes a housing 1 composed of a main body 2 and an end cap 3. The main body 2 is of generally tubular form having side walls 4 and 5, a top wall 6, a bottom wall 7 and an end wall 8. The end 9 of the body 2 opposite the end wall 8 is an open end and in the assembled condition of the scabbard is effectively closed by the end cap 3. It is preferred that the body 2 is moulded or otherwise formed as a single piece from a plastics material. That distinguishes over prior devices of the same general kind in which the body of the scabbard is formed of two or more parts which need to be secured together.

Figure 3:
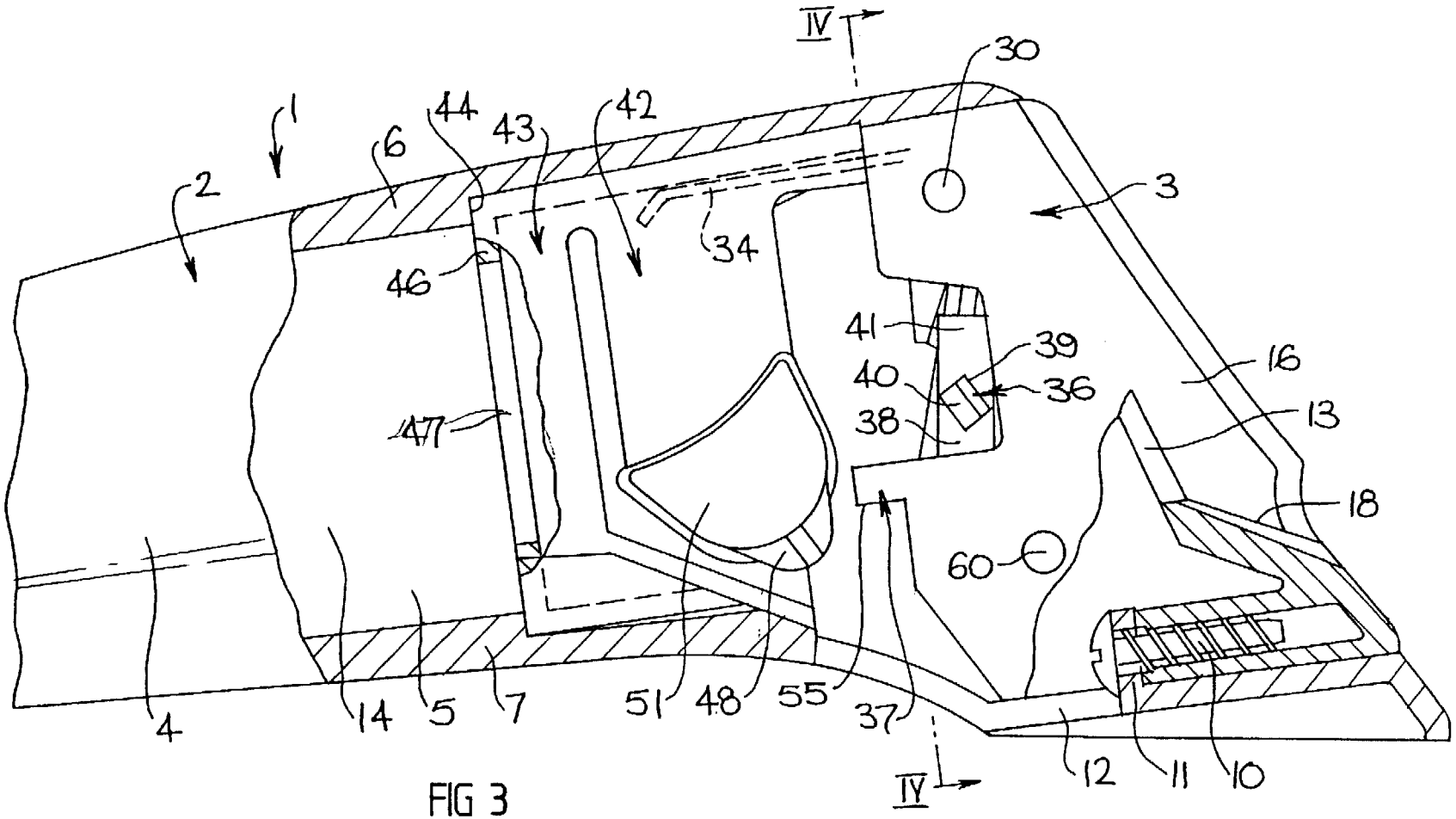
FIG. 3 is a part sectioned view, on an enlarged scale taken along line III—III of FIG. 2.

The end cap 3 may be secured to the end 9 of the body 2 in any appropriate fashion. In the particular arrangement shown that securing is achieved by locating the end cap 3 at least partially within the hollow open end 9 of the body 2 and releasably fixing the cap 3 in that position by a fastening screw 10. As best seen in FIG. 3, the screw 10 functions to clamp the end cap 3 against a locating lug 11 which is arranged upstanding from the bottom wall 7 of the body 2. The screw 10 is accessible through an opening 12 of the bottom wall 7. The arrangement is such that assembly and disassembly of the scabbard body 2 and end cap 3 is a simple and speedy operation. It will be apparent that securing means other than that particularly described could be adopted.

Figure 2:
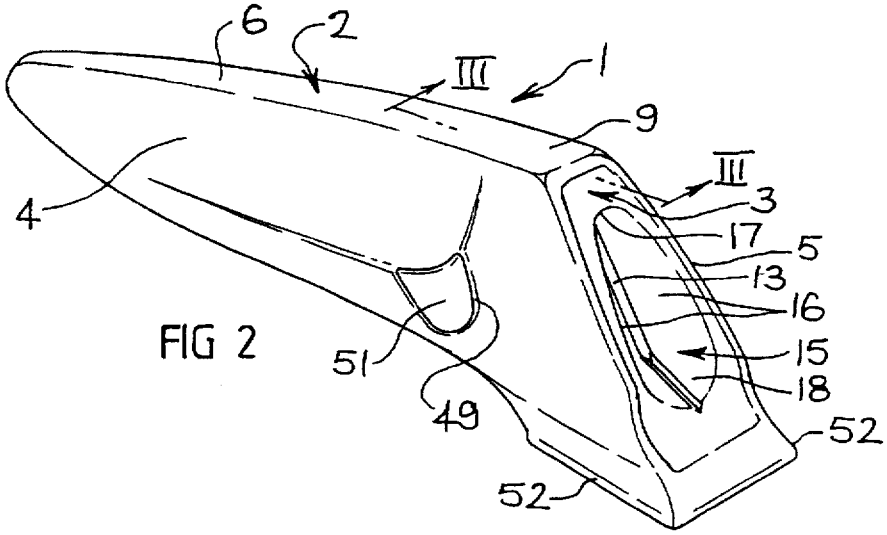
FIG. 2 is a perspective view of the scabbard shown in FIG. 1.

An access opening 13 is formed in the end cap 3 so as to permit a blade to be moved into and out of the passage 14 (FIG. 3) formed between the walls of the body 2. As shown in FIG. 2, the opening 13 is preferably in the form of an elongate slot having dimensions related to the cross-sectional shape and dimensions of the blade to be used with the scabbard. In particular, the slot opening 13 preferably forms part of guide means which keeps the blade to a particular path of travel during movement into and out of the passage 14, and which also inhibits lateral tilting of the blade during such movement. It is further preferred that the opening 13 is at the base of a cavity 15 formed in the front of the end cap 3. The side surfaces 16 and upper and lower surfaces 17 and 18 of the cavity 15 preferably diverge forwardly from the opening 13 so as to provide a conveniently accessible guide or lead for insertion of a blade into the opening 13.

Figure 5:
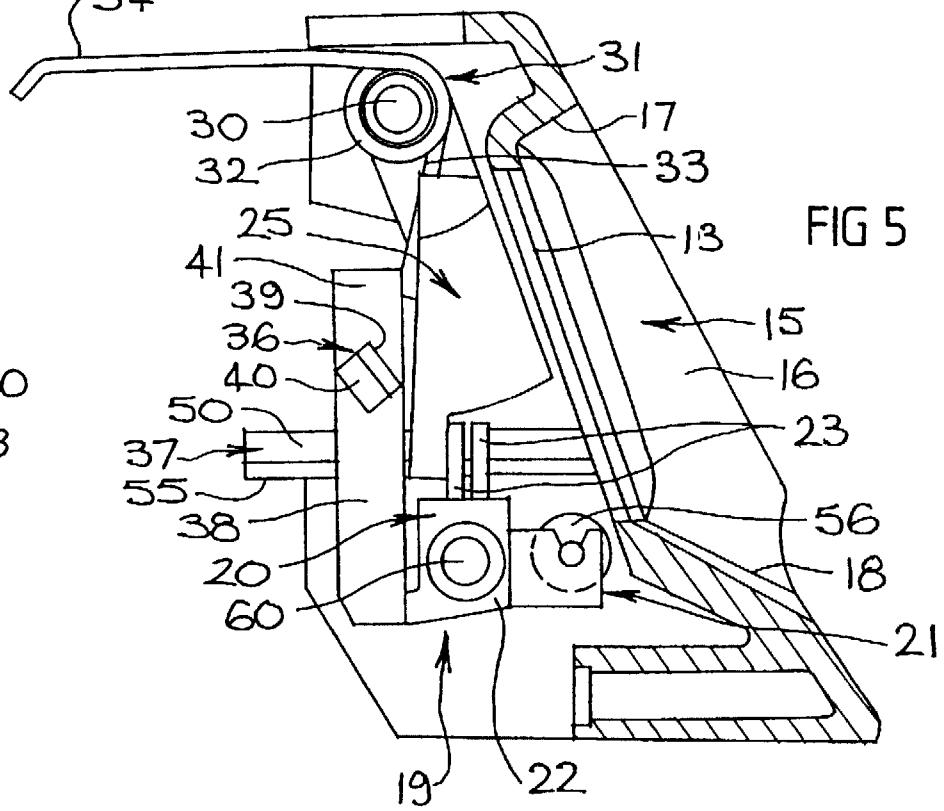
FIG. 5 is a cross-sectional view taken along line V—V of FIG. 4.
Figure 4:
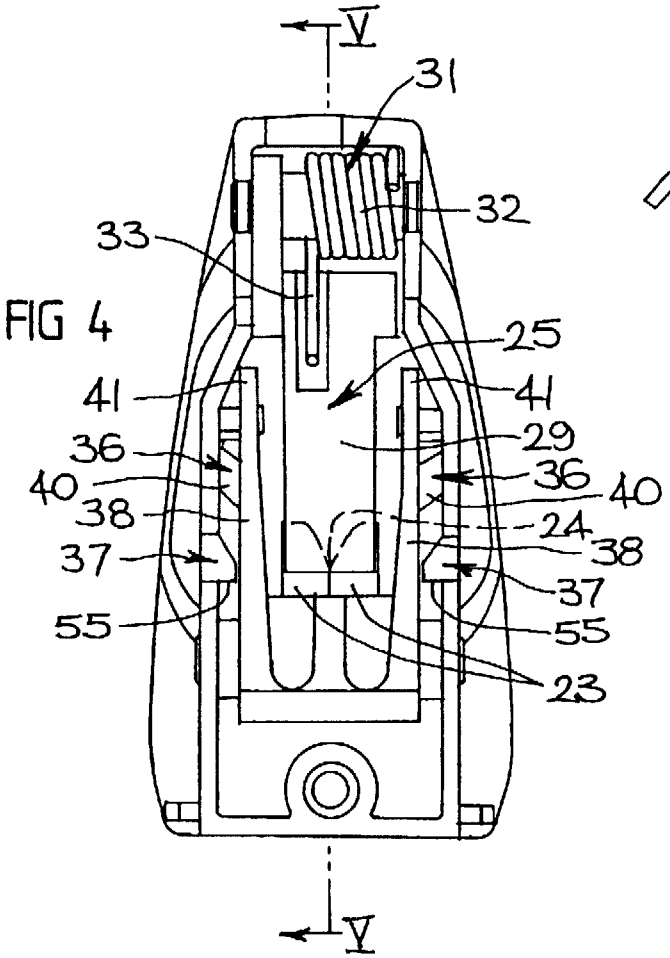
FIG. 4 is an end view of the end cap of the scabbard shown in FIG. 3 and is taken along line IV—IV of FIG. 3.

The particular scabbard 1 shown in the drawings includes sharpening mechanism 19 which is operative to sharpen the cutting edge of a blade to be stored within the scabbard 1. The mechanism 19 could take any of a variety of forms, but in the arrangement shown the mechanism 19 is generally in accordance with the disclosure of U.S. Pat. No. 5,009,040. That particular mechanism 19, which is best seen in FIG. 5, includes a sharpening device 20 which is pivotally mounted for back and forth movement about an axis 60, and also includes means 21 connected to the device 20 which functions to prevent or substantially reduce sharpening of a blade cutting edge during movement of the blade into the scabbard. The manner of operation of the means 21 is fully described in the specification of U.S. Pat. No. 5,009,040. In the arrangement shown, the sharpening device 20 includes a carrier block 22 and two overlapping sharpening plates 23 attached to that block 22. A vee shaped sharpening recess 24 is defined between oppositely facing edges of the two plates 23.

It is preferred that the sharpening mechanism 19 includes means 25 which functions to apply pressure to the back edge 26 of a blade 27 located within the scabbard passage 14 so as to thereby urge the blade cutting edge 28 towards or into engagement with the sharpening device 20. In the particular arrangement shown, the pressure applying means 25 includes a plate-like gate 29 which is located behind the base of the cavity 15 which contains the access opening 13 (FIG. 5). The gate 29 is arranged for pivotal movement about an axis 30 located well above and arranged generally parallel to the pivot axis 60 of the sharpening device 20. Biasing means 31 acts on the gate 29 so as to resiliently urge the gate against a rear surface 31 of the end cap 3 such that the opening 13 is effectively closed by the gate 29. In the particular arrangement shown, the biasing means 31 includes a helical spring 32 having two arms 33 and 34 which bear against the gate 29 and a relatively fixed surface respectively.

A groove 35 (FIG. 7) may be formed in a front side of the gate 29 so as to slidably receive the back edge portion of a blade 27. The groove 35 is arranged to function as part of the guide means for keeping the blade 27 to a particular path of travel and also for inhibiting lateral tilting of the blade 27.

The scabbard 1 includes blade restraining means which functions to at least make it difficult for a blade to be withdrawn from the passage 14. In the particular arrangement shown and hereinafter described, that restraining means acts on the blade 27, but in other arrangements in may act on the blade handle or some other member attached to the blade. Furthermore, part of the restraining means hereinafter described is movable about a pivot axis so as to adopt ether an operative position or an inoperative position, but other arrangements are possible. It is also a feature of the particular arrangement shown that the restraining means is associated with the sharpening mechanism 19, so as to be rendered operative or inoperative according to whether the mechanism 19 is inactive or active respectively. It will be appreciated that such an arrangement is not essential and that the restraining means could be provided separate from the sharpening mechanism 19.

Figure 10:
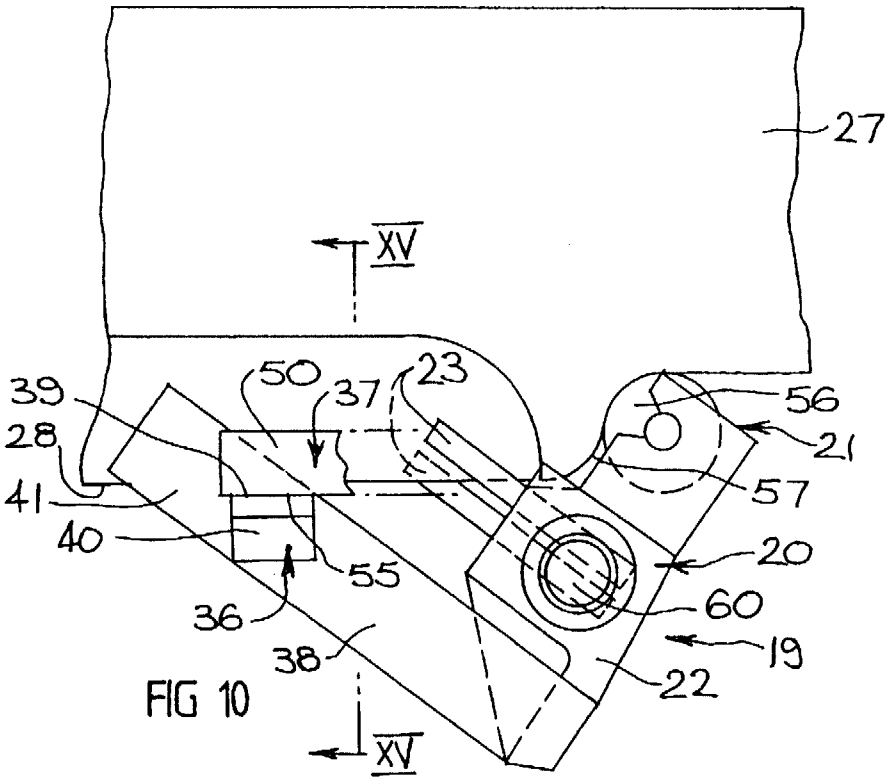
FIG. 10 is a view similar to FIG. 9 but showing the sharpening mechanism at its rearmost pivoted position.
Figure 8:
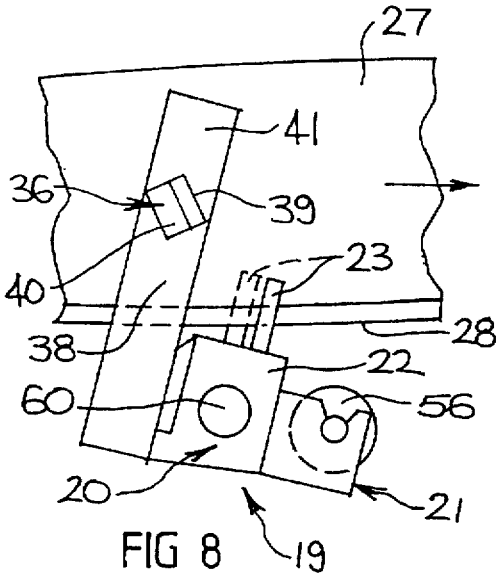
FIG. 8 is a semi-diagrammatic view of the sharpening mechanism and sharpening defeating means showing the sharpening mechanism at the forwardmost pivoted position.
Figure 9:
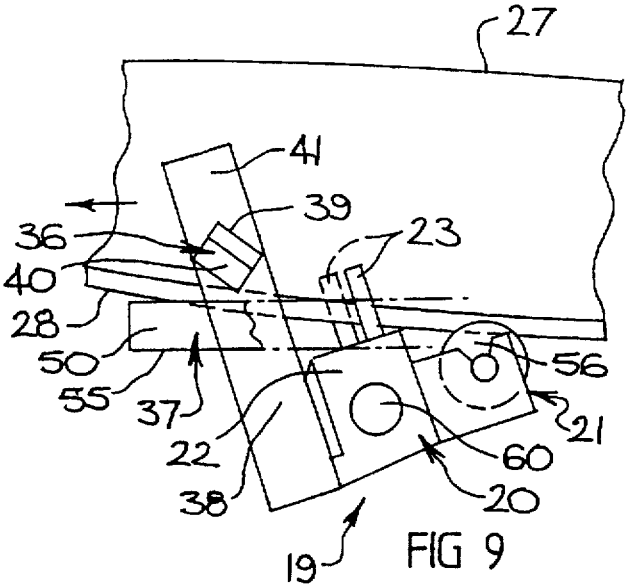
FIG. 9 is a view similar to FIG. 8 but showing the sharpening mechanism pivoted to a rearward position.

As will be apparent from FIG. 8, 9 and 10, the sharpening device 20 pivots between forward and rearward positions at which it does and does not respectively function to effectively sharpen a blade 27. That pivotal movement of the sharpening device 20 is utilised as means for changing the mode of the restraining means between operative and inoperative. It will be appreciated that a pivoted device other than one forming part of the mechanism 19 could be suitable for that purpose.

When the sharpening device 20 is in the rearward pivoted position as shown in FIG. 9, the associated restraining means is conditioned to be operative, but as hereinafter explained other requirements need to be satisfied in order for the restraining means to become operative.

It is preferred to provide locking means which operates to releasably hold the device 20 in the position shown in FIG. 10. In the particular arrangement shown, that locking means includes at least one pair of abutments 36 and 37 which cooperatively engage when the device 20 is in the rearmost pivoted position so as to thereby prevent forward pivotal movement of the device 20. Also in the arrangement shown, the abutment 36 is connected to the sharpening device 20 so as to move with that device 20 as it pivots about the axis 60, but other arrangements are possible. It is preferred, as shown, that the abutment 36 is connected to the sharpening device 20 through an arm 38. The abutment 37 is shown connected to a side of the end cap 3, but it could be connected to any other part of the scabbard 1 which is fixed relative to the sharpening device 20.

Preferably, there are two pair of abutments 36 and 37, each of which is located adjacent a respective one of the side walls 4 and 5 of the scabbard body 2, but a single pair could be adequate. Each abutment 36 preferably includes an abrupt locking face 39 and a sloping ramp face 40, each of which functions as hereinafter described. It is also preferred that each abutment 36 is located on a respective one of two arms 38 which are fixed to respective opposite sides of the sharpening device 20 and are arranged to project rearwardly when the sharpening device 20 is in the rearward pivoted positions shown by FIGS. 9 and 10. Each arm 38 may be flexible, or at least flexible at or adjacent the connection with the device 20, so as to permit the outer end portions 41 of the two arms 38 to be moved towards and away from one another for a reason hereinafter explained.

Any suitable release means may be provided to permit the restraining means to be disabled or rendered inoperative such that a blade can be withdrawn from the scabbard. An example form of release means which is particularly suited for the restraining means and the locking means previously described, is shown in the accompanying drawings.

Figure 12:
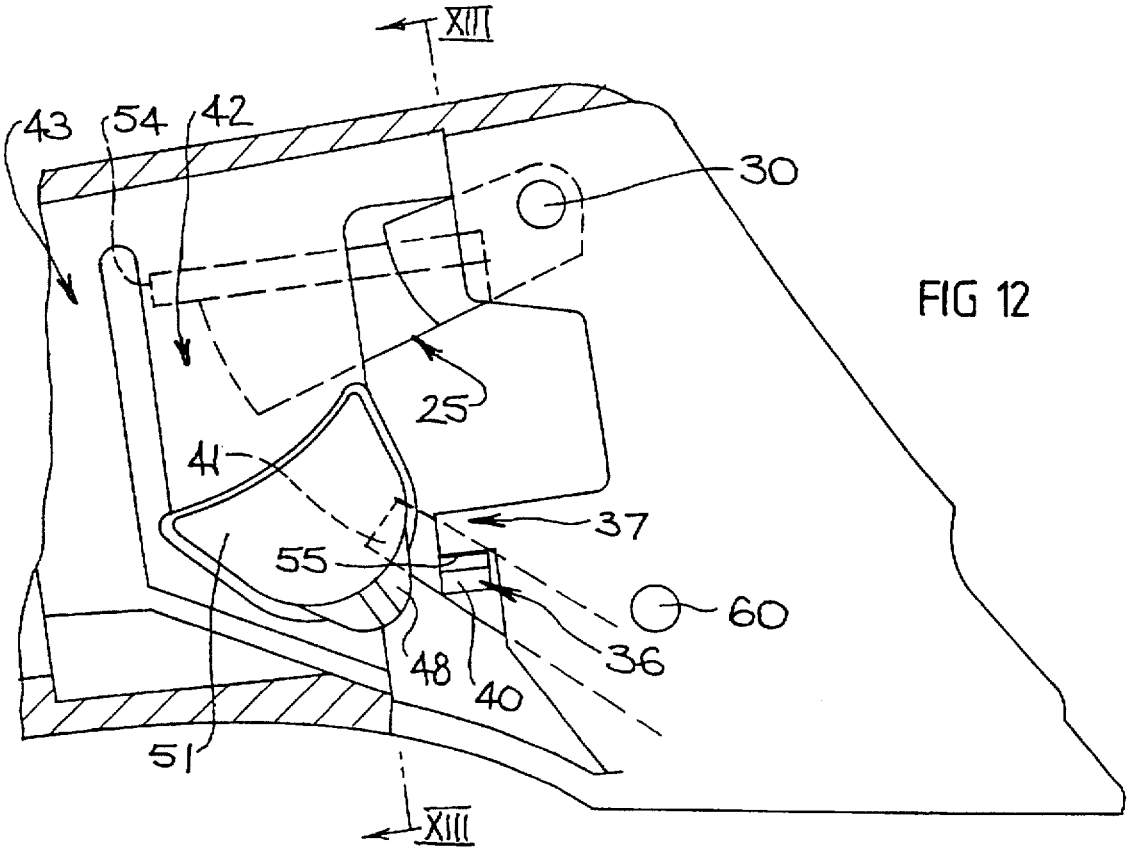
FIG. 12 is a view similar to FIG. 3 but showing the sharpening mechanism in the position shown by FIG. 10.
Figure 13:
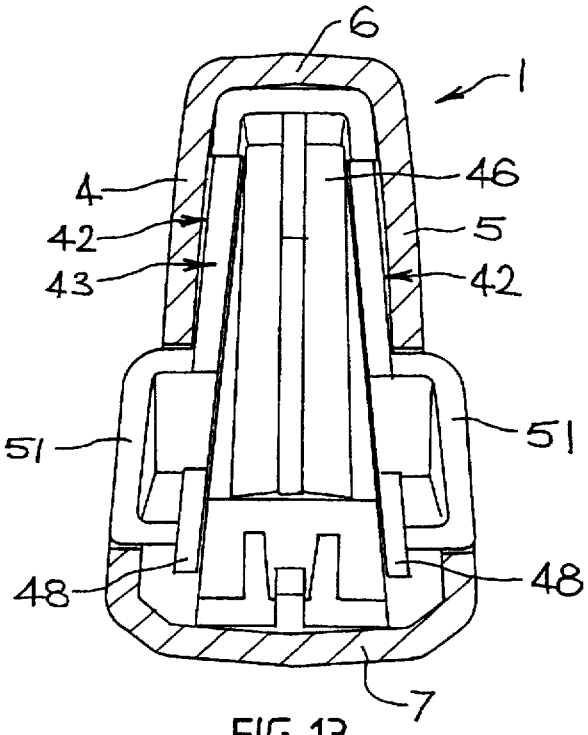
FIG. 13 is an end view of the button unit, separate from the scabbard, taken along tine XIII—XIII of FIG. 10.

The example release means includes two movable members 42 (FIGS. 3, 12 and 13) located at or adjacent respective opposite sides of the scabbard body 2 and arranged for movement towards and away from one another. Each member 42 is arranged to coact directly or indirectly with a respective one of the abutment arms 38 so as to enable disengagement of the abutments 36 and 37. For that purpose it is convenient to form each member 42 as an integral part of a sleeve-like unit 43 which is located within the scabbard body 2 adjacent the end cap 3. In the preferred arrangement shown, the unit 43 is a relatively neat fit between the walls 4, 5, 6 and 7 of the body 2, and is captured between the end cap 3 and a step 44 on the inside surface of the body 2, but other arrangements could be adopted. The position of the unit 43 is such that when the sharpening device 20 is at the rearmost pivoted position shown by FIG. 10, the end portions 41 of the arms 38 are located between the two members 42, as shown by FIG. 12.

It is preferred that the unit 43 is open at the end adjacent the sharpening device 20 and has an end wall 46 (FIGS. 3 and 13) which has a slot-like opening 47 for allowing passage of a knife blade 27. The opening 47 is preferably dimensioned relative to the cross-sectional dimensions of the blade 27 so that it functions as part of the aforementioned guide means. Each movable member 42 forms part of a respective side of the unit 43 and is connected to the main body of the unit 43 in a manner such that the lower portions 48 of the two member 42 are able to be moved towards and away from one another. The connection is preferably flexible for that purpose. It is further preferred that in the installed position of the unit 43 the two members 42 are held against respective side walls 4 and 5 by the natural bias of their flexible connections with the main body of the unit 43.

Figure 7:
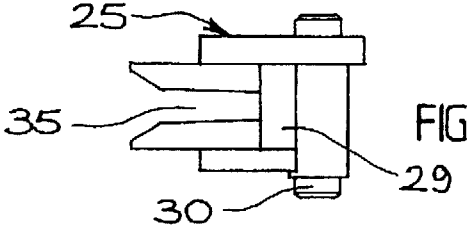
FIG. 7 is a view taken along line VII—VII of FIG. 6.

An opening 49 is provided in each of the scabbard side walls 4 and 5 to permit access to the lower portion 48 of each member 42. Each of those lower portions 48 may be outwardly stepped as shown in FIG. 7 so as to form a finger engagable button 51 which is located within a respective one of the openings 49.

Any suitable means may be adapted to secure the scabbard to a bench or other support. By way of example, a rib 52 provided on each side of the scabbard 1 may be slidably engagable within a mounting bracket adapted to be fixed to a support. Such an arrangement enables the scabbard 1 to be attached to or removed from the support according to preference.

The scabbard 1 as particularly described and shown in the accompanying drawings, operates in the following manner.

Figure 11:
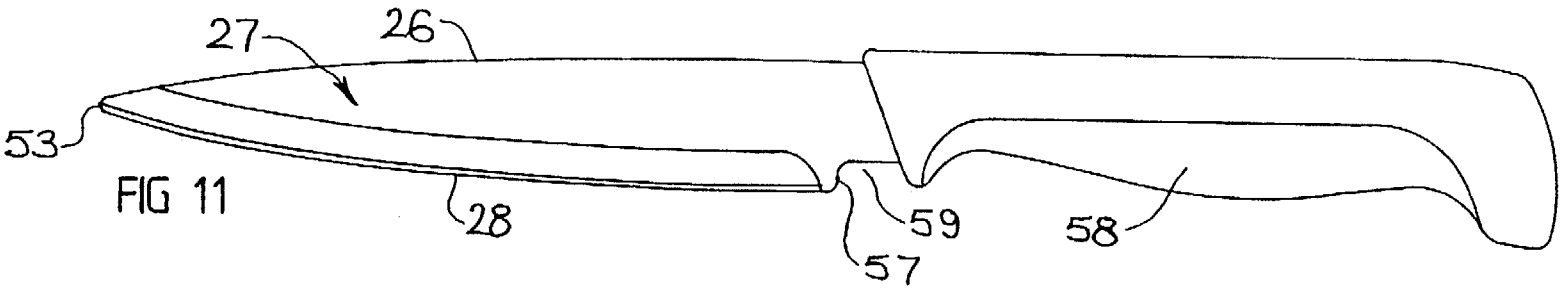
FIG. 11 is a side elevational view of a typical knife suitable for use with the scabbard of the previous Figures.
Figure 6:
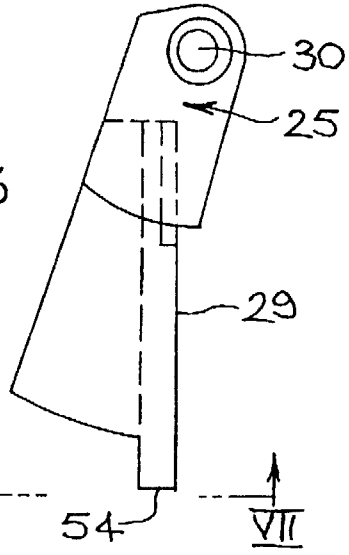
FIG. 6 is a side elevation view of the biasing gate of the scabbard shown in FIGS. 4 and 5.

When the scabbard 1 is ready to receive a knife blade 27, the sharpening device 20 will usually be at a forward pivoted position as shown in FIG. 8. In order to insert the blade 27 into the passage 14, the tip 53 (FIG. 11) of the blade is projected through the access opening 13 to press against the gate 29. The gate 29 is thereby forced to swing about the pivot axis 30 in a direction away from the opening 13 as shown in FIG. 12 so that the lower end 54 of the gate 29 rides over and along the back edge 26 of the blade 27. As the blade 27 enters the passage 14, the cutting edge 28 locates within the sharpening recess 24 and engages the plates 23 under the biasing influence of the gate 29.

Continued movement of the blade 27 into the passage 14 then causes the sharpening device 20 to swing rearwardly about the pivot axis 60 to adopt the position shown by FIG. 9 at which each movable abutment 36 engages or lies close to the upper side of the respective cooperative fixed abutment 37. It is a feature of the particular arrangement shown that the sharpening defeating means 21 engages the blade cutting edge 28 when the sharpening device 20 is in the FIG. 9 position, and the consequence of that engagement is explained below.

Figure 14:
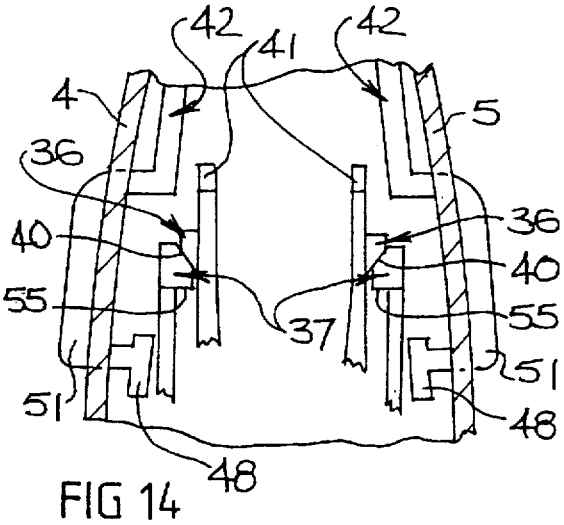
FIG. 14 is a semi-diagrammatic cross-sectional view showing the locking means progressing towards an operative condition.
Figure 15:
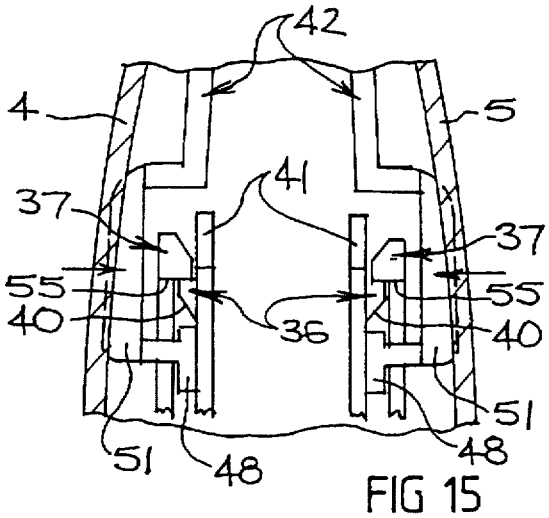
FIG. 15 is a semi-diagrammatic cross-sectional view taken along line XV—XV of FIG. 10 and showing parts not shown in FIG. 10.

In the particular arrangement shown the relative positioning of the abutments 36 and 37 as shown by FIG. 9 is retained until the blade 27 approaches the position of insertion as shown by FIG. 10. At that time the sharpening defeating means 21 moves beyond the blade cutting edge 28 end is exposed to the space 59 (FIG. 11) behind the coil 57 of the blade 27. As a consequence, the sharpening defeating means 21 is able to move upwards into the space 59 as the sharpening device 20 pivots further rearwards under the pressure imposed on the sharpening defeating means 21 by the inwardly moving knife blade 27. That further pivotal movement of the device 20 results in the ramp face 40 of each abutment 36 engaging against an upper edge of a rib 50 which forms the respective cooperative abutment 37 as shown by FIG. 14. As a result of that engagement, each of the arms 38 is progressively deflected inwards towards the other so that the abutments 36 are able to ride over their respective cooperating abutments 37. A position is thereby reached at which each abutment 36 is able to move outwardly under the biasing influence of its respective arm 38 so that the locking face 39 of the abutment 36 is located beneath and in opposed relationship with a locking face 55 of the respective cooperative abutment 37 as shown by FIGS. 10 and 15. The sharpening device 20 is thereby effectively locked against forward pivotal movement out of the position shown by FIG. 10.

When the sharpening device 20 is in the rearward pivoted position as shown by FIG. 9, the sharpening defeating means 21 engages against the blade cutting edge 28 as previously stated. That engagement imposes an upwardly directed force on the blade 27 which holds the blade edge 28 clear of engagement with the sharpening plates 23, or at least limits the pressure which can be applied between the edge 28 and the plates 23.

It is preferred that a roller 56 forms part of the sharpening defeating means 21 and that the roller 56 engages the blade edge 28 in the FIG. 9 position of the sharpening device 20. The roller 56 functions to facilitate movement of the blade 27 into the passage 14 because of its ability to rotate in the direction of blade movement, and also because it serves to lift the blade edge 28 off the sharpening plates 23, or at least reduces the pressure between the edge 28 and the plates 23 as previously discussed.

In the particular arrangement shown, the sharpening device 20 may adopt the position shown by FIG. 9 early in the movement of the blade 27 into the scabbard 1, and it will retain that position during continued movement of the blade 27 into the scabbard 1. The restraining means becomes operative when the blade 27 is at or near the position of maximum insertion into the scabbard 1 as shown by FIG. 10.

The restraining means may be of any suitable form and may operate in any suitable manner. In the particular arrangement shown, the restraining means includes or is formed by the sharpening defeating means 21 and makes use of the pivotal movement of the sharpening device 20, but in other arrangements it could be separate from and operable independent of either or both the sharpening defeating means 21 and the sharpening mechanism 19. Furthermore, the restraining means need not rely on pivotal movement as described, but could rely on linear movement for example. The particular restraining means shown is cooperable with the choil 57 of the knife blade 27 (FIG. 11), and the manner of that cooperation is shown by FIG. 10.

As is evident from FIG. 10, the blade 27 is formed so that the choil 57 of the blade 27 is located at least in part rearwardly of the roller 56 when the blade 27 is fully inserted into the passage 14. At the same time the blade 27 may drop down under the biasing influence of the gate 29, but that need not occur and is preferably kept to a minimum if it does occur. Ideally, the blade 27 should not be able to be lifted to clear the roller 56 when the roller 56 is in the FIG. 10 position, and for that purpose upward movement of the blade 27 is limited by engagement between the blade upper edge 26 and the upper edge of the opening 13.

It will be evident from the foregoing that the choil 57 and the roller 56 cooperate to create a positive stop against withdrawal movement of the blade 27. The biasing influence of the gate 29 may assist in maintaining the overlap of the choil 57 and roller 56 because it urges the blade 27 towards the bottom wall 7 of the scabbard body 2, but such assistance is preferably not the dominant influence in maintaining the operative condition of the restraining means. The openings 13 and 47 which forms part of the guide means, are preferably dimensioned to resist or prevent the blade 27 being lifted sufficiently against the biasing influence of the gate 29 to escape the restraining influence of the roller 56.

Figure 16:
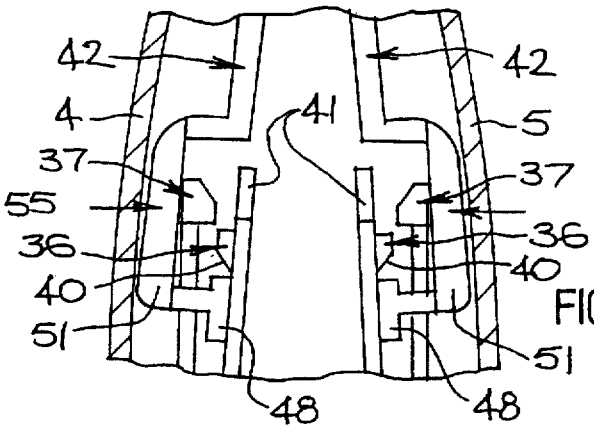
FIG. 16 is a view similar to FIG. 15 but showing the locking means released.

When it is desired to free the blade 27 for withdrawal from the scabbard 1, the user engages the two buttons 51 and presses them inwardly towards one another as shown by FIG. 16 while at the same time applying an outward pulling force on the blade handle 58. With the particular arrangement shown in the drawings, it will usually be necessary for the user to engage the buttons 51 with one hand and apply a pulling force to the handle 58 with the other hand, inward movement of the buttons 51 results in each member lower portion 48 engaging and causing corresponding inward movement of the outer end portions 41 of a respective one of the abutment arms 38. As a result, the abutments 36 are progressively moved out of locking engagement with their respective cooperative abutments 37 and the device 20 is thereby freed to swing forward about the pivot axis 60 carrying with it the roller 56.

An outward pulling force must be applied to the blade 27 at the time of release of the abutments 36 from locking engagement with the cooperative abutments 37. That is necessary in order to cause the device 20 to pivot forward to an extent such that the abutments 36 and 37 cannot re-engage if pressure is removed from the buttons 51. The need for two independent activities of that kind adds to the security of the safety lock of the scabbard, and in particular minimises the possibility of a knife blade being removed from the scabbard by a child.

Withdrawal movement of the blade 27 causes the device 20 to swing into its forwardmost position as shown by FIG. 8 at which it performs its sharpening function on the blade cutting edge 28 in a known manner. As is also evident from FIG. 8, the roller 56 is held clear of the blade cutting edge 28 while the sharpening device 20 is active for the purpose of blade sharpening.

It will be appreciated from the foregoing description that a scabbard in accordance with the present invention enables convenient withdrawal of an associated blade whilst at the same time providing a safeguard against careless or unintentional withdrawal of the blade.

Various alterations, modifications and/or additions may be introduced into the constructions and arrangements of parts previously described without departing from the spirit or ambit of the invention as defined by the appended claims.

I claim:

1. A blade scabbard including, a hollow housing for containing a blade, an access opening at an end of the housing through which said blade can be moved longitudinally to be inserted into or withdrawn from said housing, blade sharpening means positioned to be engageable by a cutting edge of said blade when said blade is located within said housing, means connecting said sharpening means to said housing to permit relative movement between an active position at which said sharpening means is operative to sharpen said cutting edge and an inactive position at which said sharpening means is not so operative, said sharpening means being responsive to movement of said blade relative to said housing so as to be thereby moved towards said inactive position when the blade is being inserted into the housing and moved towards said active position when the blade is being withdrawn from the housing, restraining means connected to said housing and being operative to coact with said blade or a member associated therewith when the blade is at a predetermined position of insertion within said housing so as to thereby prevent withdrawal of said blade from the housing, said restraining means being responsive to movement of said sharpening means into said active position so as to be thereby automatically rendered inoperative, and manual release means which is operable to render said restraining means inoperative.

2. A blade scabbard according to claim 1, wherein said restraining means is automatically rendered operative in response to a said blade being inserted into the housing and arriving at or near to said predetermined position.

3. A blade scabbard according to claim 2, wherein said restraining means is connected to said housing for movement relative thereto between two positions at which said restraining means is operative and inoperative respectively.

4. A blade scabbard according to claim 3, wherein said response to said blade insertion involves movement of said restraining means towards said operative position prior to said blade arriving at said predetermined position.

5. A blade scabbard according to claim 1, wherein said restraining means is connected to said housing for movement relative thereto between two positions at which said restraining means is operative and inoperative respectively, and said restraining means is responsive to movement of said blade relative to said housing so as to be thereby moved towards said operative position when the blade is being inserted into the housing and moved towards said inoperative position when the blade is being withdrawn from the housing.

6. A blade scabbard according to claim 5, wherein said restraining means remains operative unless said release means is operated simultaneous with said blade being moved out of said predetermined position in the direction of blade withdrawal.

7. A blade scabbard according to claim 5, including locking means which is operative to positively prevent movement of said restraining means from said operative position to said inoperative position.

8. A blade scabbard according to claim 7, wherein said locking means is responsive to operation of said release means to enable movement of said restraining means from the operative position to the inoperative position.

9. A blade scabbard according to claim 7, wherein said locking means is operative to prevent movement of said sharpening means from the inactive position to the active position thereof.

10. A blade scabbard according to claim 9, wherein said locking means is operative to maintain said restraining means operative while simultaneously preventing movement of said sharpening means out of said inactive position.

11. A blade scabbard according to claim 1, wherein said restraining means is connected to said sharpening means for movement therewith.

12. A blade scabbard according to claim 11, wherein said restraining means includes a member which is attached to said sharpening means and which is engageable with the cutting edge of said blade when the position of insertion of said blade within the housing is such that further insertion of said blade is required in order for said blade to reach said predetermined position.

13. A blade scabbard according to claim 12, wherein said member engages said cutting edge when said sharpening means is inactive and does not engage said cutting edge when said sharpening means is active.

14. A blade scabbard according to claim 12, wherein said sharpening means is rendered inactive in response to said member engaging said cutting edge.

15. A blade scabbard according to claim 14, wherein said blade is a knife blade and said member prevents withdrawal of said blade from the housing as a consequence of engaging the choll of said blade.

16. A blade scabbard according to claim 1, wherein both said restraining means and said sharpening means are connected to said housing for movement relative thereto about a pivot axis extending transverse to the direction in which said blade is moved into or out of said housing.

17. A blade scabbard according to claim 16, wherein said pivot axis extends generally transverse to the broad side surfaces of a said blade located within said housing.

18. A blade scabbard according to claim 17, wherein said locking means includes at least one pair of cooperable abutments comprising a fixed abutment and a movable abutment respectively, said fixed abutment being connected to said housing against relative movement and said movable abutment being mounted on said housing for movement relative to both said housing and said fixed abutment.

19. A blade scabbard according to claim 18, wherein said restraining means is connected to said housing for movement relative thereto between two positions at which said restraining means is operative and inoperative respectively, and said fixed and movable abutments are adapted to snap engage to render said locking means operative in response to said restraining means adopting said operative position.

20. A blade scabbard according to claim 19, wherein said movable abutment is connected to said restraining means for movement therewith and is arranged for movement relative to said restraining means to adopt either a lock position at which it is engageable with the fixed abutment or a release position at which it is not so engageable.

21. A blade scabbard according to claim 20, wherein said movable abutment is connected to the restraining means through resilient means which is operative to urge said movable abutment into engagement with said fixed abutment.

22. A blade scabbard according to claim 21, wherein said resilient means is caused to deflect during movement of said restraining means towards the operative position thereof and as a consequence of that deflection imposes a biasing force on said movable abutment such as to urge said movable abutment into said lock position when said restraining means is at or near said operative position thereof.

23. A blade scabbard according to claim 18, wherein said release means includes an arm arranged for movement relative to said housing, and said movable abutment is responsive to movement of said arm in one direction relative to said housing such as to be disengaged from or rendered disengageable with said fixed abutment.

24. A blade scabbard according to claim 23, wherein said arm is accessible through an opening in a side wall of said housing so as to be manually engageable and thereby moved in said one direction.

25. A blade scabbard according to claim 12, wherein said blade is a knife blade and said member prevents withdrawal of said blade from the housing as a consequence of engaging the choll of said blade.

26. A blade scabbard according to claim 13, wherein said blade is a knife blade and said member prevents withdrawal of said blade from the housing as a consequence of engaging the choll of said blade.

27. A blade scabbard according to claim 2, wherein both said restraining means and said sharpening means are connected to said housing for movement relative thereto about a pivot axis extending transverse to the direction in which said blade is moved into or out of said housing.

28. A blade scabbard according to claim 5, wherein both said restraining means and said sharpening means are connected to said housing for movement relative thereto about a pivot axis extending transverse to the direction in which said blade is moved into or out of said housing.

29. A blade scabbard according to claim 11, wherein both said restraining means and said sharpening means are connected to said housing for movement relative thereto about a pivot axis extending transverse to the direction in which said blade is moved into or out of said housing.

* * * * *